US006153028A

United States Patent [19]

Pleschiutschnigg et al.

[11] Patent Number: 6,153,028

[45] Date of Patent: Nov. 28, 2000

[54] PROCESS AND DEVICE FOR PRODUCING THIN METAL BARS

[75] Inventors: Fritz-Peter Pleschiutschnigg, Duisburg; Ingo Von Hagen, Krefeld; Markus Ring, Duisburg; Wolfgang Bleck, Aachen; Tarek El Gammal, Xanten; Paul Splinter, Aachen; Peter Lorenz Hamacher, Aachen; Oliver Richard Picht, Aachen, all of Germany

[73] Assignee: Mannesmann AG, Düsseldorf, Germany

[21] Appl. No.: 09/249,905

[22] Filed: Feb. 12, 1999

Related U.S. Application Data

[63] Continuation of application No. PCT/DE96/02279, Nov. 19, 1996, abandoned.

[30] Foreign Application Priority Data

Nov. 24, 1995 [DE] Germany ..... 195 45 259

[51] Int. Cl.[7] ..... B22D 23/04; C23C 2/00

[52] U.S. Cl. ..... 148/516; 148/527; 148/529; 148/534; 427/319; 427/329; 427/432; 427/436; 428/615; 164/461

[58] Field of Search ..... 428/615, 682, 428/683, 685, 925, 926, 939, 684; 427/319, 329, 432, 436; 118/405; 164/461

[56] References Cited

U.S. PATENT DOCUMENTS 4,861,682 8/1989 Hashimoto et al. ..... 428/685
5,855,238 1/1999 Pleschiutschnigg et al. ..... 427/436

FOREIGN PATENT DOCUMENTS

WO 96/27464 9/1996 WIPO .

*Primary Examiner*—John J. Zimmerman
*Assistant Examiner*—Robert R. Koehler
*Attorney, Agent, or Firm*—Cohen, Pontani, Lieberman & Pavane

[57] ABSTRACT

A device and a process for producing thin steel metal bars in which an elongated metal product is brought into contact with a molten metal causing the latter to crystallize. Different materials are used for the elongated metal product and the molten metal, whereby one of the materials is a stainless steel. A temperature of the elongated metal product, a temperature of the molten metal and a dwelling time of the elongated metal product in the molten metal are set in such a way that the molten metal crystallizes on the elongated metal product so as to form a layer having a thickness of 2% to 20% of a thickness of the elongated metal product.

9 Claims, 2 Drawing Sheets

PROCESS AND DEVICE FOR PRODUCING THIN METAL BARS

THIS IS A CONTINUATION APPLICATION UNDER 35 U.S.C. §111 and 37 C.F.R. §1.53 OF INTERNATIONAL PCT APPLICATION NO. PCT/DE96/02279, NOW ABANDONED, WHICH WAS FILED ON NOV. 19, 1996, AND CLAIMS PRIORITY FROM GERMAN APPLICATION NO. 19545259.3 FILED NOV. 24, 1995.

BACKGROUND OF THE INVENTION

1. Field of the Invention

The present invention relates to a process and a device for producing thin metal bars, especially steel bars, in which an elongated metal product is brought into contact with a molten metal causing the latter to crystallize. The device includes a metallurgical vessel with a bottom opening that holds the molten metal, through which the elongated metal product is conducted, and rollers for conducting the elongated metal product and for extracting the crystallized metal bar.

2. Description of the Related Art

Thin metal steel bars are usually produced as cold strip. Currently, approximately 60% of cold strip products are coated, particularly to avoid or reduce the corrosion of the steel during its use. In the European Union, this volume amounts to approximately 30 million tons of steel, of which 16 million tons consist of hot-galvanized or electro-galvanized strip. In recent years, the production volume of galvanized strip, especially for use in the automotive industry, has increased steadily. At the same time, the scarce zinc resources, are sufficient only for approximately 20 to 30 years, assuming the current production quantities and developed and known reserves. The recycling of zinc requires separate collection of galvanized steel scrap as well as recovery via the dust phase and enrichment, e.g., during melting in an electric furnace.

An alternative to the use of galvanized steel sheet in automobile construction is offered by aluminum sheet. The use of aluminum can similarly improve the corrosion behavior of a chassis and increase the useful life of the units. However, the use of aluminum, due to its characteristic material properties, leads to considerably higher expense in the areas of chassis deformation, joining and paintwork. Equally disadvantageous are the high production costs, especially the high energy costs, starting with aluminum, as long as primary aluminum is needed for the chassis. The aluminum-producing industry is pursuing a long-term strategy of shifting primary aluminum production out of Europe, due to energy and environmental problems. At the same time, however, the production of aluminum cold strip from secondary aluminum is itself problematic. In particular, the problem of impurities has not yet been solved.

In addition to the aforementioned solutions, a massive sheet of stainless steel can also be used. In this case, however, the high raw material costs must be noted, because large quantities of chrome and nickel alloy are required; in addition, processing must be carried out in cold strip mills specially designed for alloyed steels. For market-related reasons, a greater use of stainless steel in automobile construction, though highly desirable from the environmental point of view, has not yet occurred.

To produce thin metal bars with thicknesses less than 20 mm, especially steel bars, inversion casting is known. For example, European reference EP 0311602 B1 proposes a process and device in which an uncooled cleaned elongated metal product of low potential energy is brought into contact with a molten metal, and the latter crystallizes. An economical and metallurgically useful product is attained by virtue of the fact that an elongated metal product with selected wall thicknesses from 0.1 to 1.4 mm, in keeping with the maximum permissible contact time in the metal melt, produces a metal strand with an approximately 6- to 10-fold total strand thickness. Here, the strand consists of the metal profile and crystals deposited thereon in a phase-boundary-free manner and molten material from the metal melt.

SUMMARY OF THE INVENTION

The object of the present invention is to produce, by simple means, a metal bar of composite material that has the thinnest possible closed and securely adhering coating on the substrate profile.

In the process of the present invention an elongated metal product is brought into conduct with a molten metal thereby causing the molten metal to crystallize. The elongated metal product and the molten metal are made of different materials, one of which is a stainless steel. The temperatures of the elongated metal product and the molten metal, as well as the dwelling time of the elongated metal product in the molten metal, are controlled so as to produce the desired crystallization process. In particular, the above parameters are controlled so as to form a layer of crystallized metal having a thickness ranging from 2%–20% of a thickness of the elongated metal product. The elongated metal product can also be preheated to a temperature between ambient and a maximum of 900° C.

The device of the present invention includes an inversion casting vessel which contains the molten metal. A hole is arranged in a bottom of the inversion casting vessel through which the elongated metal product enters said vessel. The elongated metal product is conducted by a set of feed rollers arranged upstream of the inversion casting vessel and by a set of extraction rollers arranged downstream of said vessel. As the elongated metal product is conducted through the molten metal the crystallization process occurs.

According to the present invention, the layer thickness is set at 2% to 20% of the strand thickness, depending on material and use. Composite sheets are produced, in which one of the materials used is either a stainless steel, an austenitic or ferritic steel.

For use in the automotive industry, for example, the metal strip that constitutes the core of the bar is produced from deep drawing grade steel with a thickness of 1 to 10 mm. The metal strip is coated on both sides with a layer of austenitic or ferritic high-grade steel at least thick enough to ensure reliable corrosion protection under the usage conditions of the automotive industry. Such composite sheets are characterized not only by good welding of the two materials, but also by good material and deep drawing properties and high corrosion resistance.

For use in the electric industry, a composite strip is produced that has a ferro-magnetic silicon-containing steel having a silicone content of less than 10%, as its core and is coated with a paramagnetic material, or has a paramagnetic core with a coating of ferromagnetic silicon-containing steel.

To produce a thin metal bar of composite material with a thin coating, according to the present invention, the temperature of the elongated metal product, the temperature of the molten metal, and the dwelling time of the elongated metal product in the molten metal are set in keeping with the desired layer thickness. The metal profile can thereby be supplied to the metal bath either preheated or at ambient temperature.

In a process that is especially economical, particularly due to higher production quantities, a steel strip with a thickness of 3 mm, for example, is preheated in a furnace with an inert protective gas atmosphere to a temperature of approximately 870° C., placed into an inversion vessel, and brought into contact with a melt of stainless high-quality steel for approximately 2 seconds. Following the crystallization of the molten metal on the metal profile in the bath, the strand, consisting of core, sheet and coating, is smoothed in an inert protective gas atmosphere with the help of a smoothing pass to a total thickness of 3.5 mm. After this, the product is either fed in the inert protective gas atmosphere to a hot rolling stand to produce a hot-rolled intermediate thickness, so that a hot strip is used directly as a finished hot strip, or is directly fed to a cold rolling mill.

The surface of the crystalized metal is protected against oxidation, after leaving the melt bath, until the temperature of the strand is less than 400° C.

Special attention is paid to the temperature of the elongated metal product before its entry into the inversion vessel. To exactly set the desired temperature, either a heating furnace is used (e.g., a continuous annealing furnace), if a low-temperature strip is supplied, or else a cooling device is used, if a machine supplying the elongated metal product has a higher temperature than desired and is connected upstream of the inversion casting device.

In a further embodiment the elongated metal product is rolled in a hot pass so as to reduce the thickness of the elongated metal product to 20% to 50% of an original thickness of the elongated metal product.

Further, the desired temperature is settable by an inductively or conductively produced flow of electric current in the metal strip or profile.

The production according to the invention of thin metal bars of composite materials is distinguished by the following characteristics:

Good welding of surface material to core material.

Good tensile strength and good expansion behavior of the entire strand, determined primarily by mechanical properties of the core material.

Good yield point behavior, with no yield point [expansion] resulting from the corset action of the stainless steel on the soft deep drawing grade steel of the core.

Good deep drawing properties when using core material with a high proportion of deep drawing grade steel.

High corrosion resistance when using a coating of austenitic or ferritic high-quality steel.

Good recyclability, so that scrap can be used directly to produce stainless steels. Expensive alloy elements thus remain directly in material cycle. "Problem elements," such as Zn and Sn, are therefore not used.

The metal bars produced in this manner are advantageously used to substitute for galvanized steel sheets, aluminum sheets and massive sheets of stainless steel. In addition, the environmental conditions for chassis materials are improved, and the resources needed to produce stainless steel, e.g., nickel, chrome and zinc, are conserved. Furthermore, the useful life of technical products that were previously produced from conventional carbon steel is significantly lengthened.

The produced metal bars of high-melting composite materials, i.e., stainless/unalloyed or ferromagnetic/paramagnetic materials, constitute new materials with technical properties not previously attainable. Beyond the described use in automobile construction, use in transformer construction, the construction industry, the household appliance industry, machine construction, etc. is conceivable.

As a further advantage, transport protection of the coated strips is simple, compared to regular strips.

BRIEF DESCRIPTION OF THE DRAWINGS

An example of the invention is shown in the accompanying drawings.

DETAILED DESCRIPTION OF THE PREFERRED EMBODIMENTS

Figure 1:
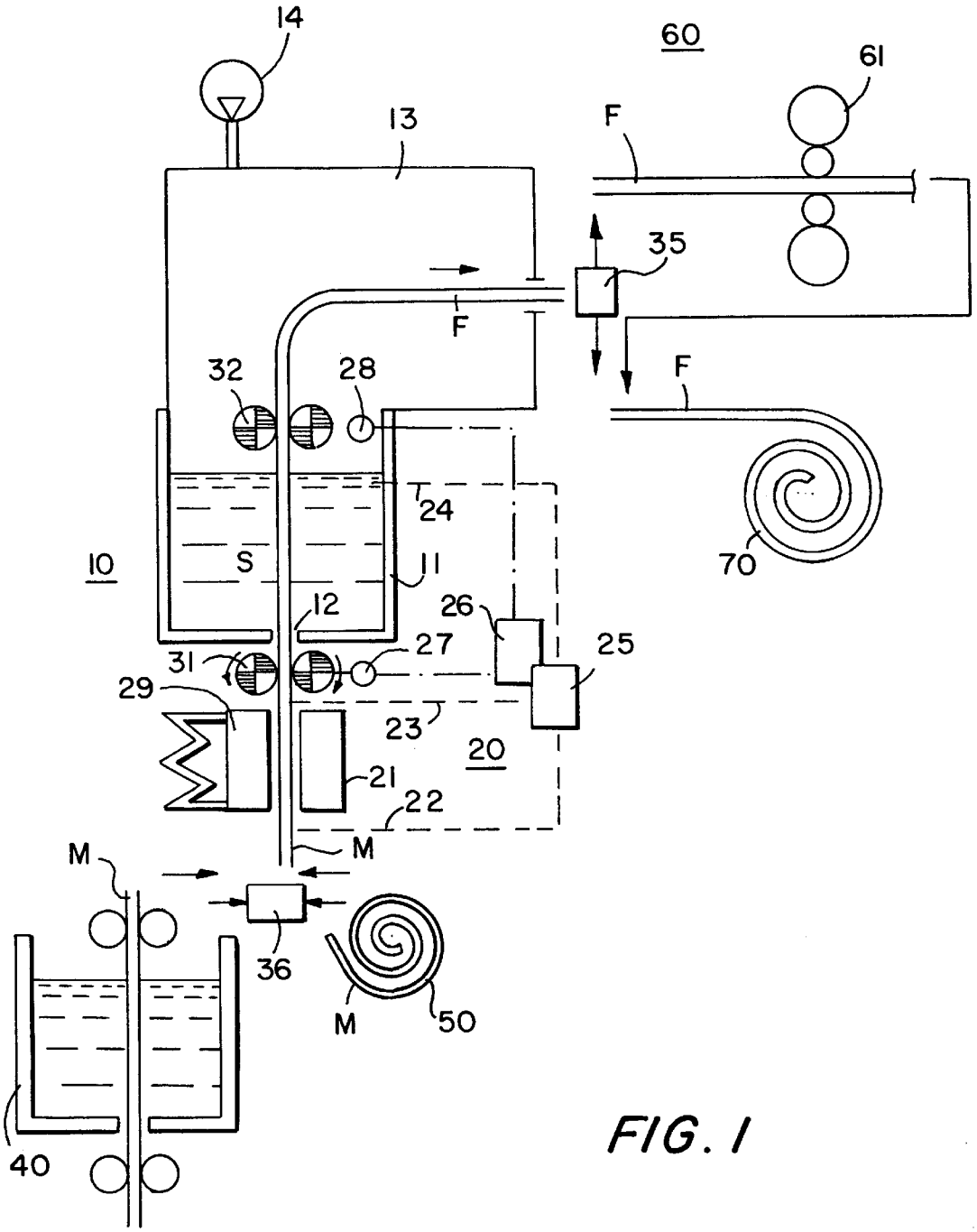
FIG. 1 Is a diagram of the present invention showing a device to produce thin metal bars.

FIG. 1 shows a diagram of a device according to the present invention for producing thin metal bars including an inversion casting vessel 11, having a bottom with an opening 12, through which an elongated metal product M is conducted. The elongated metal product M is thereby conducted by feed rollers 31 driven by a feed drive 27. The elongated metal product M leaves the inversion casting vessel 11 as a strand F which is withdrawn via extraction rollers 32, are driven by an extraction drive 28.

A melt S consisting of molten metal is placed within the inversion casting vessel 11 so that the elongated metal product M passes through the melt S. When the elongated metal product M contacts the melt S, the molten metal crystallizes producing crystals which form a protective layer on the surface of the elongated metal product The strand F after leaving the melt S is surrounded by a housing 13, to which a pump 14 is attached that supplies gas, preferably nitrogen, to an interior of the housing 13.

Before entering an inversion casting vessel 11, the elongated metal product M, which in the present embodiment is a metal strip, passes through a temperature device 20 that influences the strip temperature.

The elongated metal product M, which is stored in an upstream storage station 50, is supplied via an entry switch 36. If the elongated metal product M is colder than desired as it passes through the temperature device 20, a heating device such as an annealing furnace 21 is used, to heat the metal product M before entering the inversion casting vessel 11. Depending on requirements, the desired temperature can thus lie between ambient temperature and approximately 870° C.

The temperature of the elongated metal product M is sent by temperature sensors 22 and 23, which are arranged respectively at the entry and exit of the temperature device, to a measurement and control part 25. The measurement and control part 25 is also connected to a temperature sensor 24, which measures the temperature of the melt S. The measurement and control part 25 is further connected to a known control device 26, which in turn is connected, in terms of control technology, to the drives 27, 28 of the respective rollers 31, 32.

In another embodiment of the present invention, the elongated metal product M is produced in an upstream inversion casting device 40. If the temperature of the elongated metal product M is higher than desired, the elongated metal product M is fed to the temperature device 20, which is embodied here as a cooling device 29.

In a further embodiment of the present invention, the finished strand F is directly fed via an extraction switch 35 to a finish-processing arrangement 70. However, in yet another embodiment, via the switch 35, the strand F is supplied to a rolling mill 60 where in one step the strand F is smoothed, e.g., in a rolling stand 61, and only then is the strip fed to the finish-processing arrangement 70.

Figure 2:
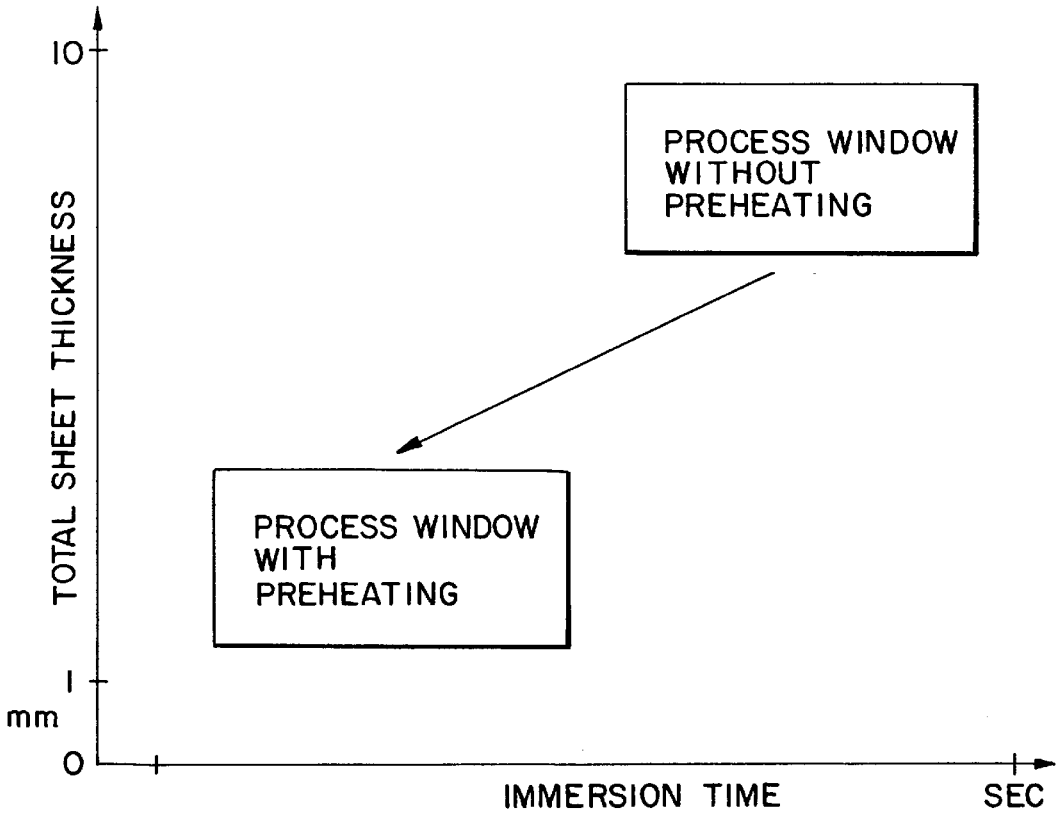
FIG. 2 Is a graph showing the dependence of a preheating effect on total sheet thickness relative to immersion time of an elongated metal product.

FIG. 2 shows, schematically, the effect of preheating on the elongated metal product. As this drawing shows, when the elongated metal product is preheated, the immersion time is clearly shorter. A shorter immersion time advantageously results in a larger production quantity.

What is claimed is:

1. A process for producing thin metal bars, comprising the steps of:

bringing an elongated metal product into contact with a bath of molten metal so as to crystallize the molten metal, the elongated metal product having a material that is different from the molten metal, wherein one of the elongated metal product and the material of the molten metal is a stainless steel;

setting a temperature of the elongated metal product, a temperature of the molten metal and a dwelling time of the elongated metal product in the molten metal so as to crystallize the molten metal on a surface of the elongated metal product forming a layer of crystallized metal having a thickness of 2% to 20% of a thickness of the elongated metal product; and rolling the elongated metal product with the layer of the crystallized metal so as to reduce a thickness of the combination.

2. The process as in claim 1, wherein the elongated metal product is one of a strip and a profile, having a strip thickness of 1 to 10 mm.

3. The process as in claim 1, wherein the material of the elongated metal product is stainless steel.

4. The process as in claim 1, wherein the material of the elongated metal product is a silicon-containing carbon steel having a silicon content of less than 10%.

5. The process as in claim 1, and further comprising the step of preheating the elongated metal product to a temperature of between ambient temperature and a maximum of 900° C., in dependence on a profile thickness of the elongated metal product.

6. The process as in claim 1, further comprising the step of smoothing a surface of the crystallized metal directly over the melt bath.

7. The process as in claim 1, further comprising the step of rolling the elongated metal product in a hot pass so as to reduce the thickness of the elongated metal product to 20% to 50% of an original thickness of the elongated metal product.

8. The process as in claim 1, wherein the material of the elongated metal product is one of a ferritic steel and an austenitic steel.

9. A process for producing thin metal bars, comprising the steps of:

bringing an elongated metal product into contact with a bath of molten metal so as to crystallize the molten metal, the elongated metal product having a material that is different from the molten metal, wherein one of the elongated metal product and the material of the molten metal is a stainless steel;

setting a temperature of the elongated metal product, a temperature of the molten metal and a dwelling time of the elongated metal product in the molten metal so as to crystallize the molten metal on a surface of the elongated metal product forming a layer of crystallized metal having a thickness of 2% to 20% of a thickness of the elongated metal product; and protecting a surface of the crystallized metal against oxidation, after leaving the melt bath, until the temperature of the strand is less than 400° C.

* * * * *